United States Patent [19]

Maedge et al.

[11] Patent Number: 4,726,697

[45] Date of Patent: Feb. 23, 1988

[54] DOCUMENT STORAGE IN PRINTERS

[75] Inventors: Werner Maedge, Villingen-Schwenningen; Dieter Mink, Niedereschach; Dieter Stellmach, Bad Duerrheim, all of Fed. Rep. of Germany

[73] Assignee: Mannesmann Kienzle GmbH, Villingen-Schwenningen, Fed. Rep. of Germany

[21] Appl. No.: 860,555

[22] Filed: May 7, 1986

[30] Foreign Application Priority Data

May 8, 1985 [DE] Fed. Rep. of Germany ..... 3516460

[51] Int. Cl.[4] ..... B41J 13/03; B65H 5/22; B65H 31/28

[52] U.S. Cl. ..... 400/625; 271/3.1; 400/617; 400/629; 400/636; 414/35; 414/43

[58] Field of Search ..... 400/617, 625, 629, 636, 400/608, 636.1, 608.1, 693; 271/3.1; 414/43, 90, 35

[56] References Cited

U.S. PATENT DOCUMENTS

| | | | |
|---|---|---|---|
| 2,240,568 | 5/1941 | Mills | 400/625 |
| 4,040,511 | 8/1977 | Beaven | 400/617 X |
| 4,219,191 | 8/1980 | Rastorguyeff | 271/3.1 |
| 4,365,793 | 12/1982 | Van Blokland | 271/3.1 |
| 4,436,297 | 3/1984 | Chandhoke | 271/3.1 |
| 4,447,167 | 5/1984 | Euteneuer | 400/625 |
| 4,462,509 | 7/1984 | Adelberger | 271/3.1 X |
| 4,552,350 | 11/1985 | Nagy | 271/3.1 X |
| 4,616,817 | 10/1986 | Yamauchi | 271/3.1 X |
| 4,618,302 | 10/1986 | Kokubo | 414/43 X |
| 4,637,598 | 1/1987 | Bouwens | 271/3.1 |

*Primary Examiner*—Paul T. Sewell

*Attorney, Agent, or Firm*—Ralf H. Siegemund

[57] ABSTRACT

A self service printer is improved by providing for temporary storage of several printed documents to be issued as a bundle. An opening in the housing for the printer is normally closed by a pivotable cover behind which documents are accumulated and stored, a first set of transport rollers including drive and pressure rollers is arranged behind the cover and being provided for cumulatively holding and moving one or more individual documents; second set of transport rollers is disposed upstream from the first set of rollers and operated in opposition such that the first set provides for holding or transport and the second set is open and vice versa; a control device operates the cover and said transport roller sets and provides (i) a closed disposition of said cover in an open position for said first set of rollers permitting insertion of documents in between through the second set, (ii) a closed disposition for the cover as well as closed disposition of the first transport roller set for holding and storing documents in between, and (iii) providing issuance of the documents for open cover and closed first set of transport rollers, said transport rollers then being driven; the second set is open during (ii) and (iii).

9 Claims, 8 Drawing Figures

5
18
22
23
24
26
27
29
30
32
33
34
35
37
38
41
52
54
55
56
57
58
59
63
64
65
66
67
68
69
70
71
74
75
76
77
79
80

21
22
18
56
55
19
23
54
60
5
58
79
27
25
26
36
28
20
41
32
31
33
78
53
30
29

DOCUMENT STORAGE IN PRINTERS

BACKGROUND OF THE INVENTION

The present invention relates to a device for the temporary storage of a record slip such as a transaction slip, account statement or other documents prior to their controlled issuance, in conjunction with and from a self service type printer. Devices of the kind to which the invention pertains are used for example in banks or similar institutions, e.g. in the so called automated bank tellers which are equipped with self service printers. The user(customer) of the automatic teller, after having inserted his personal ID card may receive a printed statement of his or her account status including past and/or present transaction record slips or the like. These statements are normally of a particular (physical) length. In some instances it may have occurred that the user has not received (or called for) an account statement for a lengthy period of time will receive or will have to receive a statement which should include all previous activities concerning his/her account but the length of the report is insufficient for that purpose. One could in such an instance simply provide as many account statement slips as there are activities but this is not an advantageous procedure, particularly not as long as the printer is still occupied with the printing of the data.

DESCRIPTION OF THE INVENTION

It is an object of the present invention to provide a new and improved self service printer for use in automated tellers or the like and including a stapling or other record accumulation device which makes it possible to temporarily retain and store printed slips until the printer has completed the printing of all data necessary for the completion of the particular documentation. It is a feature of the invention to provide a temporary storage facility for automated print-out documents and self service printers which permit storage of a limited number of documents commensurate with the reasonably expected average maximum number of such documents to be stored which is in the order of 10 to 20 slips and it is therefore a specific object and feature of the invention to provide a stacking, storing and retaining device for that specific purpose.

The invention considers basically equipment for the temporary storage of documents prior to controlled issuance in conjunction with a self service printer and is characterized by means of an opening in the printer casing for the emergence of a printed document or documents which opening is provided with a pivotable cover for opening and closing but serving also as an abutment for the documents to be stored temporarily and cooperating with a first pair of transport rollers including drive and pressure rollers being arranged immediately behind the pivotable flap or cover and being provided for cumulative stopping on one hand or transporting on the other hand a plurality of printed documents. Moreover a control apparatus is included for sequencing opening and closing of the flap or cover and operating the transport rollers insertion of documents can be carried out for a closed pivot cover and open transport rollers; the documents for closed pivotable cover will be stored whenever the transport rollers are in a closed position without being driven; and finally, the issuance of documents requires the pivotable cover to open while the transport rollers are closed and are then being driven.

In furtherance of the invention, guide surfaces are provided behind the first pair of transport rollers for limiting the stacking and storage space on both sides. In front of the storage space a second pair of transport rollers is provided which move the documents away from the printer and towards the storage space. Another feature of the invention provides the pressure rollers of both transport roller sets to be controlled so that mechanically they alternate positively as far as cooperation with the respective drive rollers are concerned, in a mutually exclusive relationship. Here then the pressure roller of the first set of transport rollers are mounted on a common shaft above the associated drive roller while the pressure rollers of the second set are disposed below their respective associated drive rollers. The shafts of the pressure rollers are held by means of a control lever which constitutes a component of the control device. This particular lever has two operating positions so that in one position the pressure rollers of the first set are in operating position and in the alternative position the pressure rollers of the second set are in operating position whereby in each instance the respective other set of pressure rollers are off their respective operating position.

The inventive device offers the advantage that with very little expenditure and very few parts a very effective storage and stacking of documents to be issued can be provided for. The printer itself has control over the final issuance of the documents as stacked. The printer will do so after it has completed all of the requisite printing tasks. The customer will receive all documents covering the activities of his or her account within a given period or a period determined by the last producing issuance of an account statement.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 2 is shown in two parts, namely 2A and 2B respectively showing left hand and right hand portions.

Proceeding now to the detailed description of the drawings FIG. 1 illustrates a housing, casing or container 1 arranged underneath the self service printer proper and containing a stack 2 of sheets 2 in the so called Laporello form i.e. individual, preprinted forms are still interconnected to form a common sheet or web 3. This web will be fed to the printer 4. The printer includes a cover 5 which houses a paper feeder including a sprocket wheel 6 for feeding sheet stock to a platenlike support 7. The sprocket wheel 6 is driven by a motor 8 through a belt drive and transmission 9. A hold down flap 10 causes the sheet 3 to be forced onto the sprocket wheels.

Figure 1:
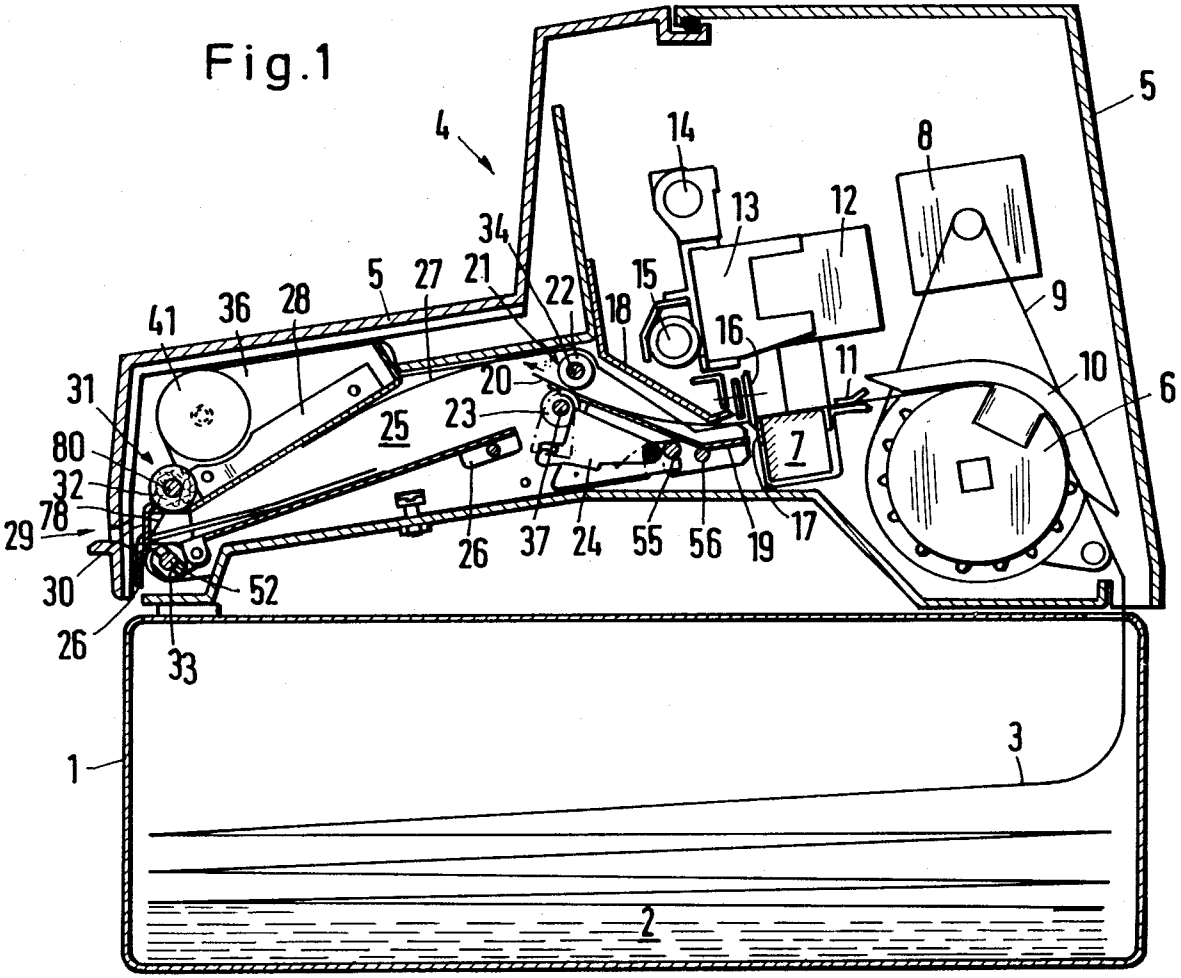
FIG. 1 is a cross section through a self service printer incorporating an example of the preferred embodiment of the invention for practicing the best mode thereof.

The sheets 3 are fed through guide elements 11 to the platen 7 to reach the operating range of the printhead 12. This head 12 is mounted on a carriage 13 for movement on two shafts 14 and 15 serving as tracks. Accordingly the head will be moved in a direction which is at right angles to the plane of the drawing of FIG. 1. The print head 12 is preferably but not necessarily of the needle variety but any other printhead can be used, though matrix printing generally is envisioned here as presently constituting the best mode of realizing devices in which the invention can be practiced.

The carriage 13 is additionally equipped with a cutter wheel 16 cooperating with a cutting edge 17 that extends along the platen 7, the cutting wheel is moved alongside said edge 17 but is normally in a retracted position. Whenever necessary, required or desired individual sheets can cut off the web 3 in that the printhead runs across the web with protracted cutter sheet 16. This aspect is conventional and is not part of the invention.

Two guide plates 18 and 19 are provided to run an individual document 20, but prior to its separation from the remainder of the web, towards a transport roller set 21. Within the terminology used in the introduction to the specification this set 21 was identified as a second set of transport rollers. This second set of transport rollers is comprised of drive rollers 22 and pressure or hold down rollers 23. A feeler or sensor 24 monitors whether or not a document is between the transport rollers 21, and as long as this is not the case the feeler or sensor provides, in a conventional manner, an electrical output which so indicates. This output is received by electronic components of the control device of the printer at large which is not shown and does not by and in itself constitute a part of the invention.

After a particular document 20 has been completed as far as printing is concerned, this completion is signaled inside the control device of the computer and causes the roller set 21 to close which means that the rollers 23 urge the sheet against the drive rollers 22. Immediately thereafter the document 20 is severed through the cutter 16 and 17 from the web 3. The transport rollers 21 remains close during the cutting by means of the wheel 16 as the printhead moves across the sheet 3. Therefore the transport set 21 in this instance serves as clamping and holding device for the document 20 now severed from the sheet.

Following the cutting the rollers 22 are being driven so that the set 21 moves the document in the direction towards the storage space 25. This space 25 is defined and established through a lower guide plate 26 and two upper guide plates 27 and 28. Plates 19 are arranged respective to roller set 21 such that the document 20 is deflected upwardly; then it hits the guide plate 27 whereupon the sheet is run along the plates 27 and 28 towards a transport roller set 31.

The housing 5 is provided with opening 29 through which documents can be issued. This opening is normally closed by means of a pivotable cover or flap 30. The tranport roller set 31 is arranged immediately behind the cover 30 and constitutes, within the terminology introduced above, the first set of transport rollers. This first set of transport rollers 31 is comprised of upper pressure rollers 32 and lower driven rollers 33.

Figure 2A:
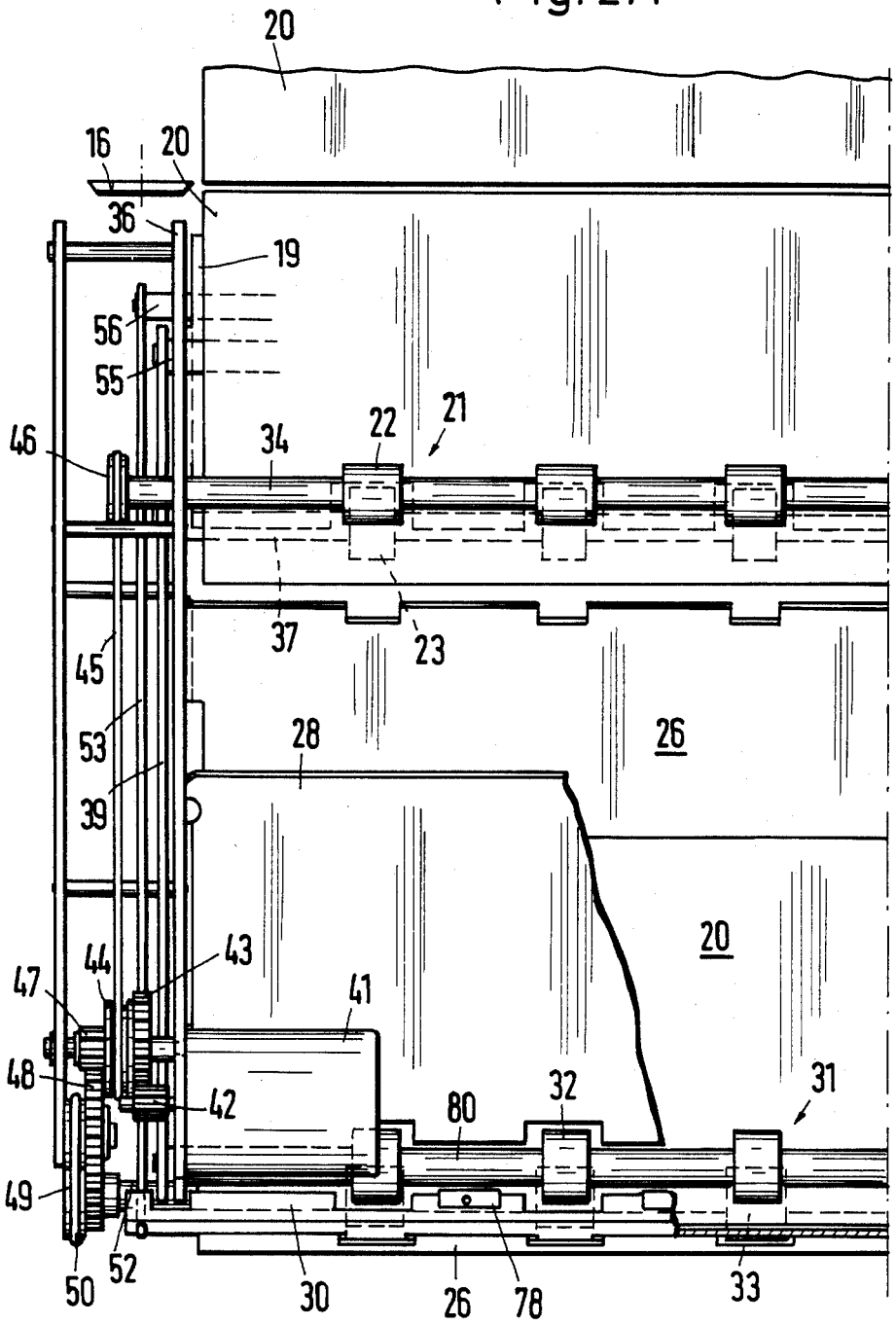
FIG. 2 is an internal top elevation of the storage facility included in the printer shown in FIG. 1.
Figure 2B:
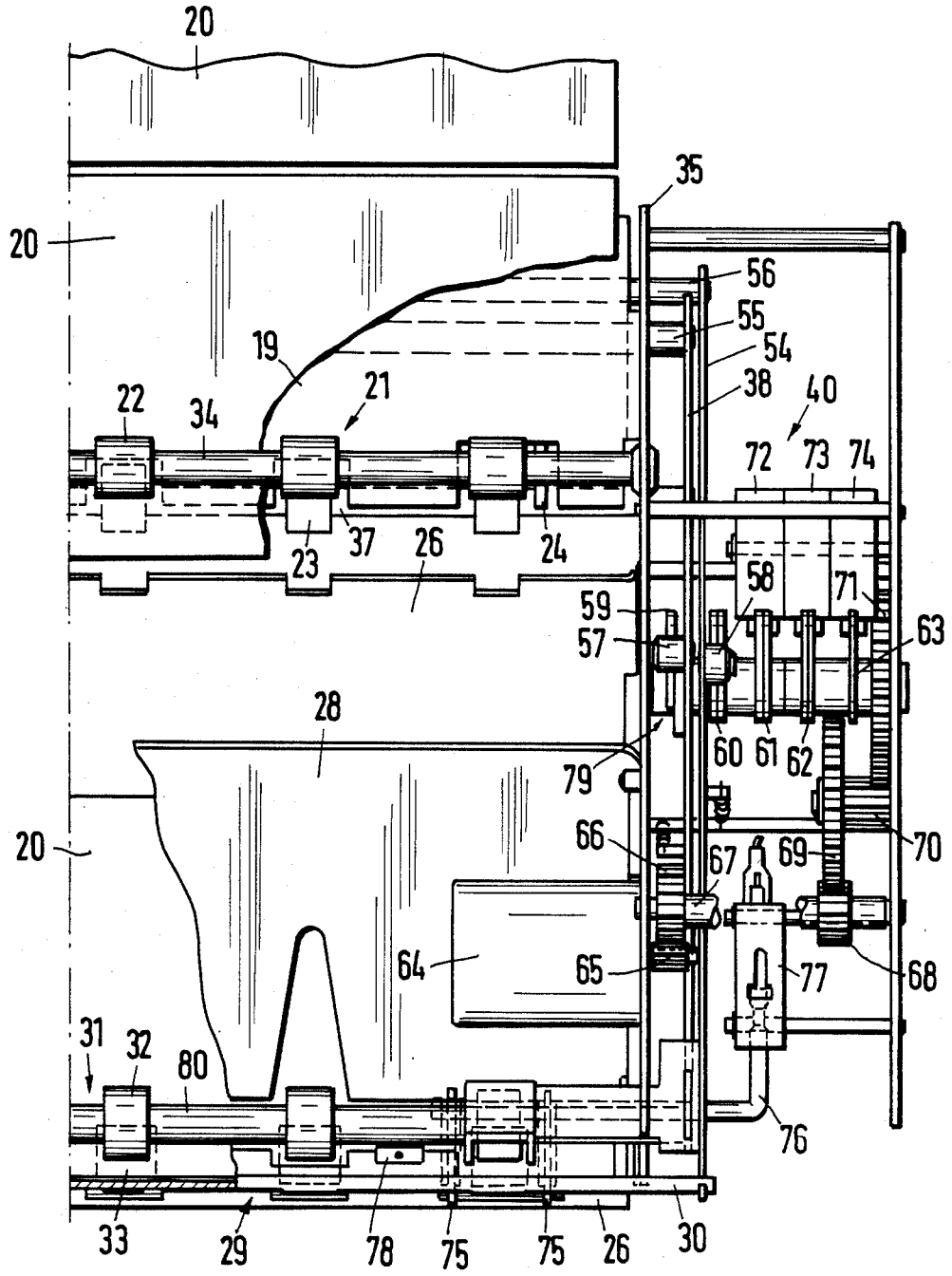

As can be seen from FIGS. 2A and 2B the drive rollers 22 of second set 21 are mounted on a shaft 34 which in turn is mounted between two guide elements 35 and 36. The pressure rollers 23 are held and mounted on a shaft 37 which extends between and is mounted to two control levers 38 and 39 respectively on both sides of the plates 35 and 36. The control lever 38 and 39 are mechanical components and in that capacity pertain to the control device structure 40 which in addition to the mechanical part is complemented by the requisite electronic parts which are not shown and can be regarded to be realized in a conventional manner.

The two levers 38 and 39 have the task to operate the pressure rollers 22 of the second set of rollers 21 as well as the pressure rollers 32 of the first set 31. That task is to provide operating - engaging and disengaging positions alternatingly and in a mutual exclusive relationship. Accordingly the pressure rollers 32 of the first set 31 are held by means of a shaft 80 which is also mounted in between two control levers 38 and 39. The drive roller 33 of the first set 31 are mounted between the plates 35, 36 on a shaft 52.

The pressure rollers 23 and 32 are made up of a material which is characterized, at least at the surface, by high friction and low shore hardness so as to obtain elastic or resilient engagement upon providing sheet transport. Wear is compensated here to a certain degree on account of the choice of the material. It was found that any readjustment is hardly if ever necessary, and the noise of the device is quite low during operation.

Figure 6:
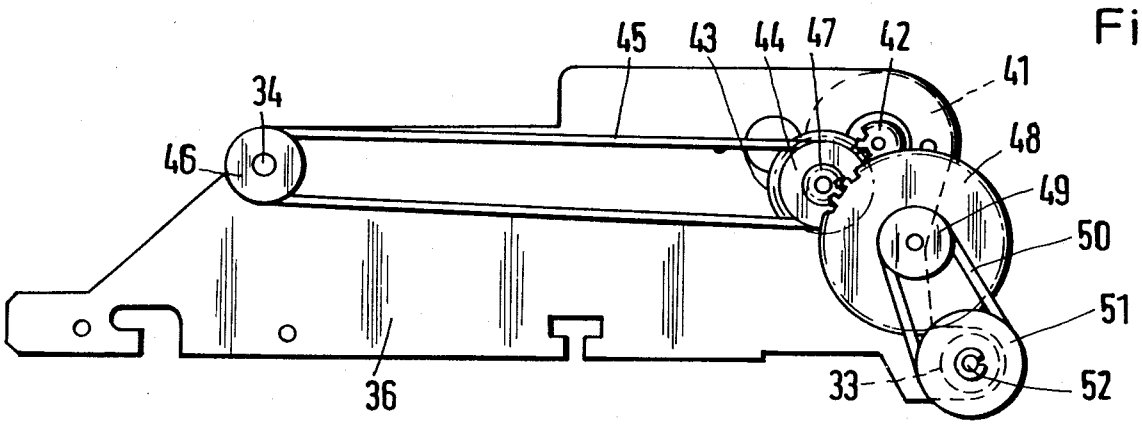
FIG. 6 is an elevational view of the transmission and gearing for the transport rollers incorporated in the device shown in the previous figures.

For driving rollers 22 and 33 components are provided which are shown in the left part of FIG. 2. They are in side view visible in FIG. 6. The drive includes the motor 41 driving a pin 42 which meshes a gear 43 which in turn drives a belt sheave 44. The sheave, wheel, or roller 44 is in engagement with and moves a transport belt 45 being run in addition around a sheave or wheel 46, and this wheel 46 is connected to the shaft 34 of the transport roller 33 of set 31. The gear 43 and the wheel 44 moveover establish a drive train component which includes another pinion 47 meshing a gear 48. Gear 48 is by itself connected with a belt sheave or wheel 49 being in engagement with the belt 50. The belt 50 runs also around a wheel 51 for driving the shaft 52. As stated above, the transport rollers 33 of the first set 31 are driven by this shaft 52. The engagement between wheel 51, driving shaft 52, and the shaft 52 itself is based on friction so that the rollers 33 with the shaft 52 can in some way freewheel upon pulling a document out of the slot even though the motor 41 and therefore the drive for the wheels 33 has stopped.

The pressure rolls 32 and 23 are, as stated, held between the two levers 38 and 39. The pivotable cover 30 is analogously held by and between two control levers 53 and 54. For this the control levers 38 and 39 are arranged on a common pivot shaft 55 while the two levers 53 and 54 are mounted on a common pivot shaft 56. The shaft 55 moreover functions in addition as a resilient torsion device which ensures that all of the pressure rollers 23 and 32 respectively and over the entire length of their respective shafts 37 and 80, engage the respectively everywhere associated drive rollers 22 and 33 under pressure.

The levers 38 and 39 obtain control movement through feeler or scanning roller 57 while the two control levers 53 and 54 are operated by a scanning roller 58. The rollers 57 and 58 cooperate respectively with cam disks 59 and 60 being arranged on a cam shaft 79. The cam shaft 79 holds additional cam disks 61,62 and 63. All these components are mechanical in nature and belong to the control device 40.

The control movement obtains through a bidirectional control motor 64 fastened to a plate 35. The motor 64 drives a pinion 65 which meshes a gear 66 on a shaft 67 to drive another pinion 68. The pinion 68 meshes a gear 69. A small gear 70 rotating with gear 69 drives a gear 71 which is connected to the shaft 79 on which all the cam disks 59–63 are mounted.

It is of advantage to use two motors, one (41) for obtaining the transport movement and the other one (64) for obtaining the control motions. A single motor could be used with appropriate control and coupling functions being interposed. However it was found to be more practical to separate completely the transport motion and the control motions as for their operation which also facilitates and simplifies requirements for the electronic control.

The cam shaft 79 as stated operates the scanning rollers 57 and 58 which in turn operate the two control levers 38 and 54. In addition a plurality of microswitches 72,73,74 are operated through other cams 61,62 and 63. These microswitches signal to the electronics an indication of the various operating states of the mechanical parts as described. FIG. 2 illustrates another scanning device 75 being arranged in the vicinity of the pivotable flap or cover 30 and operating through linkage 76 and any other microswitch 77. This arrangement has the task to signal whether or not paper is still present between the transport rollers 31 or not.

Figures 3, 3A:
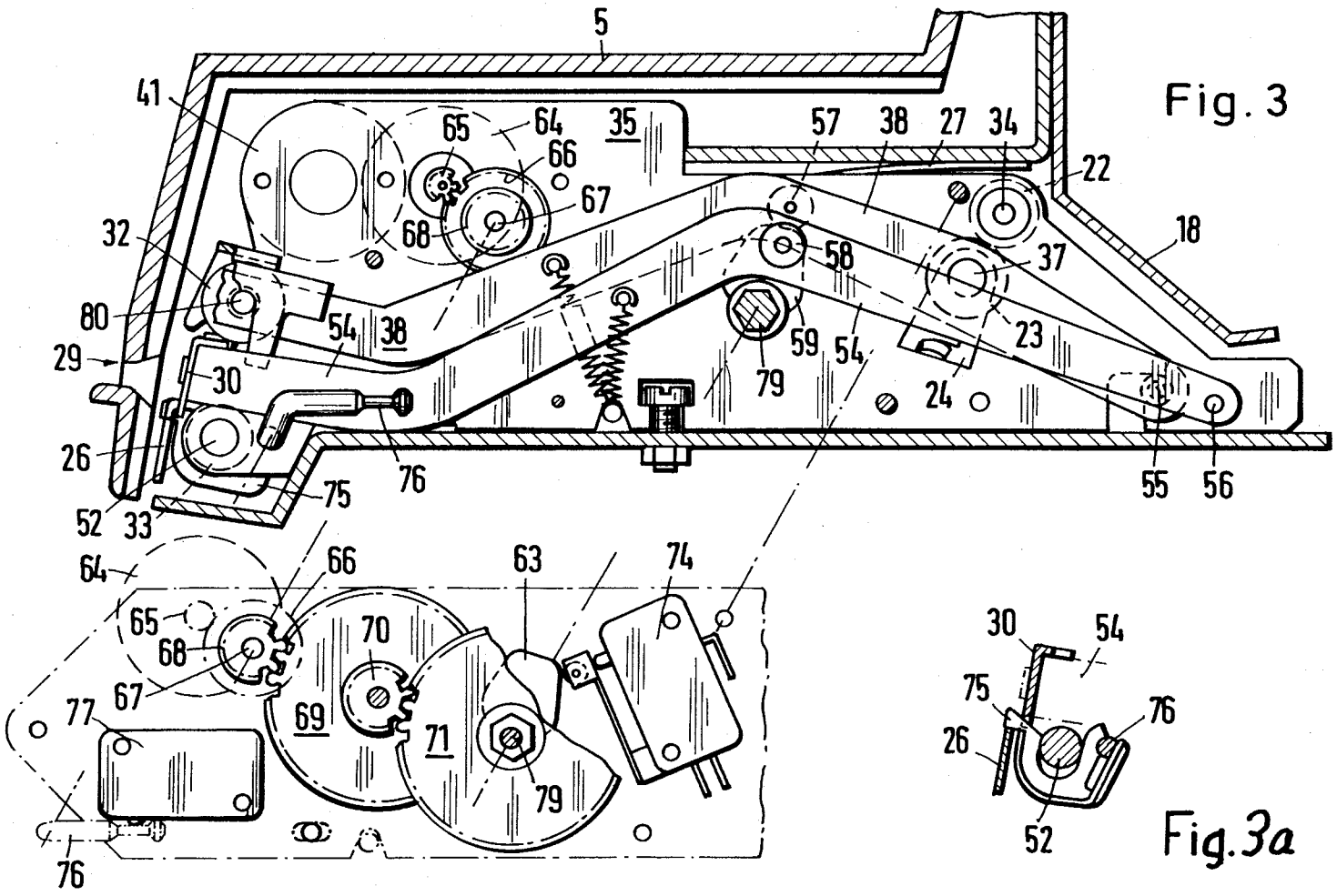
FIG. 3 is a cross section view through the mechanically relevant portion of the control device operating the storage facility in accordance with the preferred embodiment as shown in FIG. 1.
FIG. 3*a* shows a detail of FIG. 3.
Figure 5:
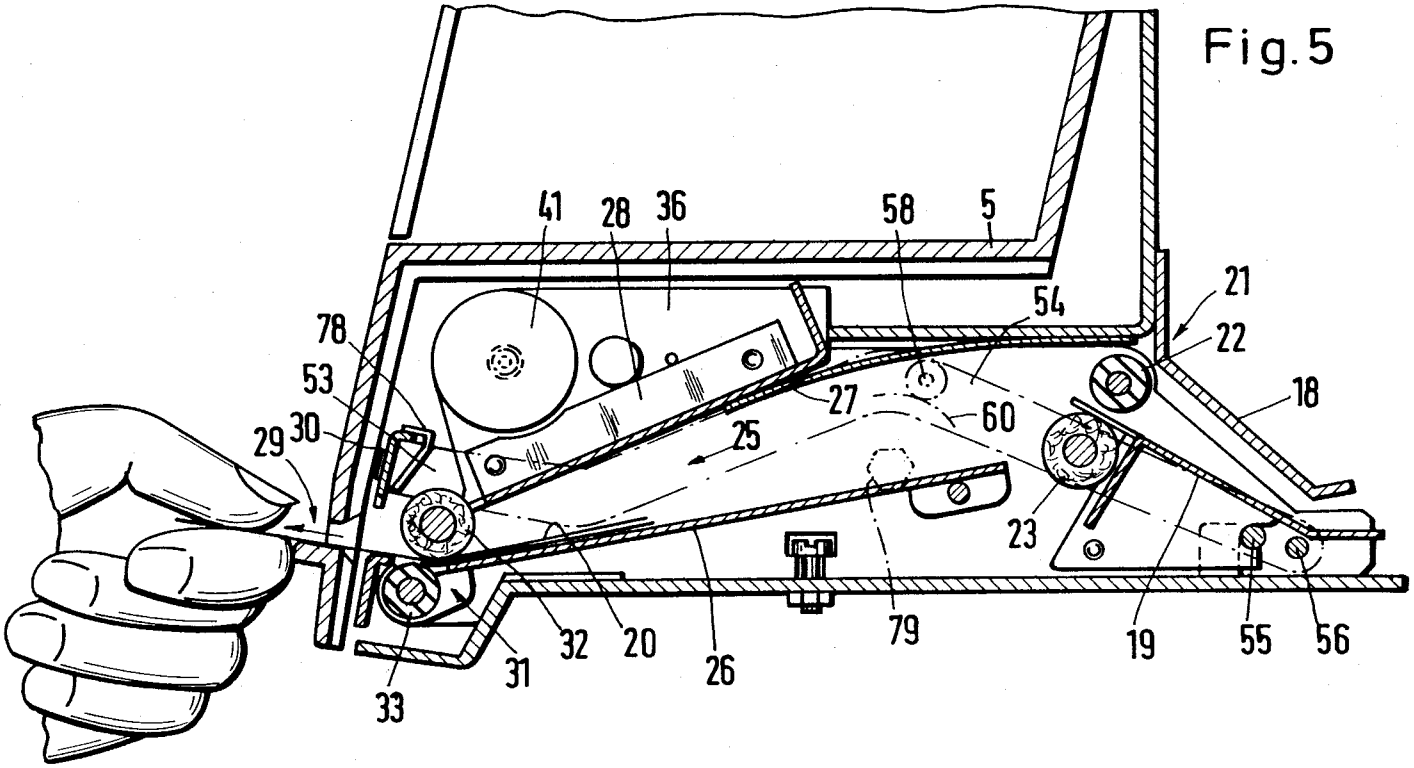

FIG. 5 shows cover 30 in an open position, while FIG. 3 shows that cover in a closing position. FIG. 3*a* shows that position and condition in cross section. Herein lever 54 bears upon guiding sheet 26. Upon pivoting lever 54 actuates gear 75. The document 20 abuts cover 30 and is straightened by operation of springs 78. The feeder 75 is connected with a rod linking 78 which upon pivoting of feeder 75 operates the shaft 77 to indicate that a document on a pile of documents is ready for removal.

Figure 4:
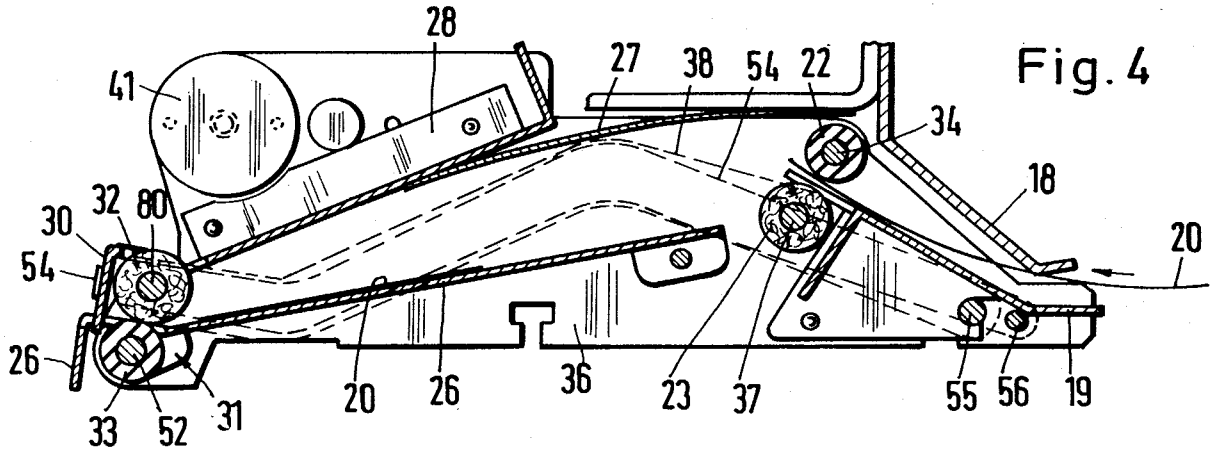
FIG. 4 and FIG. 5 are respectively views similar to FIG. 3 but showing the structure in various operating positions.

The function of the device as illustrated can best be understood and demonstrated in regard to a comparison of the position of the pivot cover 30 and of the transport roller sets 31 and 21 in the various positions of operation as shown in FIGS. 1,4,5.

FIG. 4 illustrates the basic operating state; a number of documents have been accumulated between and are held by the first transport roller pair 31; they are held therein for storage in space 25. As stated the pivot cover 30 is lowered and covers the exit opening of housing 5 so that the documents 20 cannot emerge. During the driving of any of the documents 20, cover 30 serves as a stop for the particular document as well as for those which have already been accumulated. In order to improve the stopping position of the cover 30 an attenuating spring 78 is provided, constructed as a leaf spring and being fastened to the pivot cover 30. FIG. 4 moreover shows the transport roller sets 31 in engagement so that the documents in space 25 cannot shift in relation to each other.

On the other hand the second set of rollers 21 is open and a new document 20 running between the plates 18 and 19 can now be placed between the drive rollers 22 and pressure rollers 23. This is the basic position characterized specifically as far as the invention is concerned by holding the documents in the stack in a resting and storing position. In case stacking is to take place the various parts assume the position shown in FIG. 1.

As shown in FIG. 1 the second set of rollers, 21, closes and the drive rollers 22 are driven. Accordingly a document moves between the two guide sheets 27 and 28 and the guide sheets 26 on the other hand in the direction towards the first set of rollers 31. On account of mutual exclusivity the roller set 31 is open. Movement occurs until the document abuts the closed cover 30. Spring 78 attenuates the abutting of the documents against the flap 30. As soon as the feeler or scanner 24 finds that any document is not held between the transport roller set 21 the motor 64 moves the control device 40 towards the basic or normal position as was explained with reference to FIG. 4. This means that the documents as stacked are now held and clamped between the rollers of the set 31 while the rollers 21 are open to receive the next document.

It can thus be seen that the stacking and accumulating operation proceeds in that the system alternates between the positions shown in FIG. 4 and FIG. 1 to stepwise obtain printed documents and to accumulate and stack them in the stated fashion. It is assumed that the printer issues a signal that printing is completed so that the documents as a whole may exit. For this the roller sets 21 and 31 maintain a position shown in FIG. 4 i.e. the normal or basic position. In distinction to the previously described operation and operating state the control lever 54 is now lifted above the feeler 58 such that the documents can emerge through the opening since the cover 30 has now been lifted. This condition is shown in FIG. 5.

Motor 41 will receive a low level current (assuming it is a DC motor) so that the stack of documents in its entirety will be advanced to some extent. It is now up to the user or operator to grip the stack and pull it out as shown by the hand in FIG. 5. Owing to the frictional engagement between the shaft 52 and the belt wheel 51 this pulling motion can override any holding action provided by the transport rollers of set 31. As soon as the feeler 75 signals the complete absence of documents in the storage area 25 the electronic will issue a command so that the device in its entirety, through driving of the motor 64, will be turned to the normal position shown in FIG. 4. Accordingly the pivot cover 30 closes the opening and the system awaits the next document and printing task.

The invention is not limited to the embodiments described above, but all changes and modifications thereof, not constituting departures from the spirit and scope of the invention, are intended to be included.

What is claimed is:

1. In a self service printer and apparatus for temporary storage of printed documents and including structure for controlled issuance of such documents and having a housing, the combination comprising an opening in the housing for the printer;

a pivotable cover for selectively covering said opening and closing the same, the cover being provided as abutment and stop for documents to be stored inside the housing;

a first set of transport rollers including drive and pressure rollers and being arranged inside said housing directly behind said cover, said first set being provided for cumulatively holding and moving one or more individual documents; and a control device for operating said cover and said first transport roller set including drive means for the set and providing (i)

a closed disposition of said cover in an open position for said first set of rollers permitting insertion of documents in between, (ii)

a closed disposition for the cover as well as closed disposition of the first transport roller set for holding and storing documents in between, and (iii) providing issuance of the documents for open cover and closed transport rollers, said transport rollers then being driven.

2. Apparatus as in claim 1 and including a second set of transport rollers upstream from the first set of rollers and being operated in opposition such that the first set provides for holding or transport when the second set is open and vice versa.

3. Apparatus as in claim 2 said control device including cam operated structure driven by a bidirectional control motor.

4. Apparatus as in claim 2 each of said first and second roller sets being comprised of pressure rollers and trnsport rollers, there being common means connected to the pressure rollers of the first and second set such that the pressure rollers of one of the sets is placed in engaging position while the pressure rollers of the other set are in disengaging position and vice versa.

5. Apparatus as in claim 1 the drive means being a first drive motor for driving said drive rollers of the first and second set and in unison, there being a second motor included in the control device driving a camshaft being coupled operatively to said cover and to said pressure rollers.

6. Apparatus as in claim 1 and including resilient attenuating means connected to and holding said pivotable cover.

7. Apparatus as in claim 2 including a guide plate positioned in relation to said second roller set such that a sheet is deflected in upward direction for placement towards the roller of the second set, there being upper guide plates for downwardly deflecting said sheet and web as emerging from the rollers of the second set to be guided towards the rollers of the first set.

8. Apparatus as in claim 4 said common means operated by and mounted to a pivot shaft functioning as torsion device such that the engagement of the pressure rollers mounted thereto of the first and second sets have uniform engaging pressure over the entire length of the shaft.

9. Apparatus as in claim 1 wherein said rollers of the first set are mounted to have frictional engagement to obtain limiting free wheeling capabilities.

* * * * *